US009130324B2

(12) United States Patent
Furuya et al.

(10) Patent No.: US 9,130,324 B2
(45) Date of Patent: Sep. 8, 2015

(54) LEVER LOCK CONNECTOR AND CONNECTOR UNIT HAVING THAT

(75) Inventors: Yoshinobu Furuya, Makinohara (JP); Hirotaka Hasegawa, Makinohara (JP); Hiroyasu Matsumura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 166 days.

(21) Appl. No.: 13/885,029

(22) PCT Filed: Nov. 14, 2011

(86) PCT No.: PCT/JP2011/076171

§ 371 (c)(1),
(2), (4) Date: May 13, 2013

(87) PCT Pub. No.: WO2012/067065

PCT Pub. Date: May 24, 2012

(65) Prior Publication Data

US 2013/0224974 A1 Aug. 29, 2013

(30) Foreign Application Priority Data

Nov. 15, 2010 (JP) ..... 2010-254659

(51) Int. Cl.
*H01R 13/627* (2006.01)
*H01R 24/00* (2011.01)
*H01R 13/629* (2006.01)

(52) U.S. Cl.
CPC ..... *H01R 24/005* (2013.01); *H01R 13/62938* (2013.01)

(58) Field of Classification Search
CPC ..... H01R 13/62938
USPC ..... 439/157, 924.2
See application file for complete search history.

(56) References Cited

U.S. PATENT DOCUMENTS 5,855,488 A * 1/1999 Heintz et al. ..... 439/310
5,913,691 A * 6/1999 Clark et al. ..... 439/157

(Continued)

FOREIGN PATENT DOCUMENTS

JP 11-3743 A 1/1999
JP 11-003743 A 1/1999

(Continued)

OTHER PUBLICATIONS

Supplementary European Search Report dated Sep. 26, 2014, issued for the European patent application No. 11841665.0.

(Continued)

*Primary Examiner* — Neil Abrams
(74) *Attorney, Agent, or Firm* — Locke Lord LLP; James E. Armstrong, IV; Brian S. Matross

(57) ABSTRACT

A connector 1 has a housing 4 including a side wall 42 extending from a base plate 41, a pair of projections 45 projecting from the side wall, and a lever 5 including a pair of plate members 50A having a guide groove 53 and a plate connecting member 50B connecting the pair of plate members. The lever is positioned from a release position to a slide start position, at which the surface of the base plate is in parallel to and slid along the lengthwise direction of the guide groove 53, and tube members 59, 71 and locking members 46, 58 are engaged. A first surface 5*a* at a side apart from the guide groove is perpendicular to a slide direction at the slide position and a second surface 5*b* at a side near to the guide groove is perpendicular to a connecting direction Z at the release position. When the lever 5 reaches a lock position, detect connectors in tube members 59, 71 become engaged to close the power circuit.

4 Claims, 5 Drawing Sheets

(56) References Cited

U.S. PATENT DOCUMENTS

| | | | | |
|---|---|---|---|---|
| 5,913,703 | A * | 6/1999 | Suzuki et al. | 439/701 |
| 6,044,551 | A * | 4/2000 | Jarrett | 29/868 |
| 6,325,648 | B1 * | 12/2001 | Bilezikjian et al. | 439/157 |
| 6,619,970 | B2 * | 9/2003 | Fukushima et al. | 439/157 |
| 6,648,669 | B1 * | 11/2003 | Kim et al. | 439/357 |
| 6,982,393 | B2 * | 1/2006 | Matsui et al. | 200/335 |
| 7,307,227 | B2 * | 12/2007 | Buettner | 200/51.11 |
| 7,438,570 | B2 * | 10/2008 | Mori et al. | 439/157 |
| 7,438,577 | B2 * | 10/2008 | Bridges et al. | 439/260 |
| 7,500,865 | B2 * | 3/2009 | Natter et al. | 439/362 |
| 7,544,074 | B2 * | 6/2009 | Buck et al. | 439/144 |
| 7,666,027 | B2 * | 2/2010 | Takehara | 439/489 |
| 7,872,206 | B2 * | 1/2011 | Matsunaga et al. | 200/335 |
| 7,934,939 | B2 * | 5/2011 | Chen et al. | 439/352 |
| 8,083,533 | B2 * | 12/2011 | De Chazal | 439/188 |
| 8,241,052 | B2 * | 8/2012 | Mulot et al. | 439/299 |
| 8,303,320 | B2 * | 11/2012 | Loncar et al. | 439/157 |
| 8,379,375 | B2 * | 2/2013 | Furuya et al. | 361/642 |
| 8,628,344 | B2 * | 1/2014 | Cole | 439/352 |
| 8,696,373 | B2 * | 4/2014 | Yagome et al. | 439/310 |
| 8,827,729 | B2 * | 9/2014 | Gunreben et al. | 439/188 |
| 8,834,187 | B2 * | 9/2014 | Furuya et al. | 439/153 |
| 8,854,797 | B2 * | 10/2014 | Ikeda et al. | 361/643 |
| 8,911,245 | B2 * | 12/2014 | Okamoto et al. | 439/157 |
| 8,986,024 | B2 * | 3/2015 | Ikeda et al. | 439/157 |
| 2003/0057958 | A1 | 3/2003 | Fukushima et al. | |
| 2005/0098419 | A1 | 5/2005 | Matsui et al. | |
| 2012/0295463 | A1 * | 11/2012 | Okamoto et al. | 439/310 |
| 2013/0224974 | A1 * | 8/2013 | Furuya et al. | 439/153 |
| 2014/0213087 | A1 * | 7/2014 | Furuya et al. | 439/271 |

FOREIGN PATENT DOCUMENTS

| | | | |
|---|---|---|---|
| JP | 2002-231379 | A | 8/2002 |
| JP | 2003-068397 | A | 3/2003 |
| JP | 2003-100382 | A | 4/2003 |

OTHER PUBLICATIONS

International Search Report dated Feb. 7, 2012, issued for PCT/JP2011/076171.

* cited by examiner

LEVER LOCK CONNECTOR AND CONNECTOR UNIT HAVING THAT

TECHNICAL FIELD

This invention relates to a lever lock connector, which is moved closer and fitted with a mating connector by rotating a lever, and a connector unit having the same.

BACKGROUND ART

A usual lever lock connector is provided at an electric car as shown in FIGS. 4 and 5 so as to be locked with a mating connector 102 which is arranged at an electric circuit for supplying electric power from a battery to a load side.

The lever lock connector 101 includes a housing 104 in which terminals (not shown) are received, a pair of plate members 150A clamping the housing 104 therebetween, an operation member 150B as a plate connecting member joining the pair of plate members 150A to each other, and a lever 105 arranged rotatably at the housing 104.

The housing 104 includes a base plate 141 which the terminals are provided, a side wall 142 extending vertically from an edge of the base plate 141 and a pair of rotation pivots 145 as projections projecting from the side wall 142 so as to be apart from each other.

The pair of plate members 150A respectively includes a linear guide groove 153 through which each of the pair of rotation pivot 145 is passed.

The lever 105 is attached to the mating connector 102 and rotated around the rotation pivots 145 from a release position (corresponding to FIG. 4A) in which a surface of the base plate 141 intersects a lengthwise direction of the guide groove 153 toward a slide start position (corresponding to FIG. 4B) in which the surface of the base plate 141 is arranged in parallel to the lengthwise direction of the guide groove 153. Thereafter, the lever 105 is slid along the lengthwise direction of the guide groove 153 (corresponding to FIG. 4C). An arrow Z shown in FIG. 4 indicates a connecting direction for attaching the lever 105 to the mating connector 102. An arrow X indicates a slide direction for sliding the lever 105 about the housing 104.

The connector 101 includes a vertical surface 105*a* arranged at a side apart from the guide groove 153 of the operation member 150B so as to be vertical to the slide direction (direction by the arrow X) when the lever is located at the slide start position, and a horizontal surface 105*b* arranged at a side near to the guide groove 153 of the operation member 150B so as to be vertical to the connecting direction (direction by the arrow Z) when the lever is located at the release position, as shown FIG. 5. The vertical surface 105*a* is provided for receiving a force by an operator when the lever is slid from the slide start position.

The horizontal surface 105*b* is provided for receiving a force by the operator for rotating the lever 105 from the slide start position to the release position and pulling up the operation member 150B (the connector 101) along an opposite direction (direction by the arrow Z) opposite to the connecting direction when maintenance of an electric system of an electric car having the connector 102 is acted.

CITATION LIST

Patent Document

Patent Document 1: Japan Patent Application Published No. 2003-100382

SUMMARY OF INVENTION

Objects to be Solved

According to increase of number of electronic devices mounted at a vehicle, it is required to secure a space for rotating the lever 105 of the connector 101 within an engine room in which many electronic devices are mounted.

Therefore, a lever lock connector 201 shown in FIGS. 6 and 7 is proposed. The same components in FIGS. 6 and 7 as components of the mentioned above connector 101 are marked with the same marking and explanation for the components is omitted. The lever lock connector 201 is designed to reduce a rotating angle of the lever 105 so as to cross the surface of the base plate 141 and the lengthwise direction of the guide groove 153 and form an angle between the surface of the base plate 141 and the lengthwise of the guide groove 153 to be less than 90 degree. Thereby, a required space for rotating the lever 105 is reduced. By reducing the rotating angel of the lever 105, the horizontal surface 205*b* of the operation member 150B is arranged not to be vertical to the opposite direction opposite to the connecting direction (direction by the arrow X) when the lever 105 is located at the release position. Thereby, a pulling force for pulling the lever 105 is divided so that operatability of the lever 105 is worsened.

According to the above problems, an object of the present invention is to provide a lever lock connector having good operatability and a connector unit having the lever lock connector.

How to Attain the Object of the Present Invention

In order to overcome the above problems and attain the object, the present invention claimed in claim 1 is to provide a lever lock connector which includes a housing having a base plate, in which a terminal is arranged, a side wall extending vertically from an edge of the base plate, and a pair of projections projecting from the side wall so as to be apart from each other; and a lever having a pair of plate members arranging the housing therebetween and having a linear guide groove, through which each of the pair of projections is passed, and a plate connecting member connecting the pair of plate members; and in which the lever is attached to a mating connector, and rotated around the projections from a release position, at which a surface of the base plate intersects a lengthwise direction of the guide groove so as to form an angle between surface of the base plate and the guide groove lower than 90 degree, to a slide start position, at which the surface of the base plate is in parallel to the lengthwise direction of the guide groove, and slid along the lengthwise direction of the guide groove; in which the plate connecting member includes a first surface at a side apart from the guide groove and a second surface at a side near to the guide groove, and the first surface is arranged vertically to a slide direction when the lever is located at the slide start position, and the second surface is arranged vertically to a connecting direction when the lever is located at the release position.

The present invention claimed in claim 2 is the lever lock connector claimed in claim 1 in which an end at a side near to the plate connecting member of the plate member is curved along a rotating direction.

The present invention claimed in claim 3 includes the lever lock connector claimed in claim 1 or 2 and a mating connector which the lever lock connector is connected with.

Effects of the Invention

According to the present invention claimed in claim 1, the lever lock connector includes a housing having a base plate, in which a terminal is arranged, a side wall extending vertically from an edge of the base plate, and a pair of projections projecting from the side wall so as to be apart from each other; and a lever having a pair of plate members arranging the housing therebetween and having a linear guide groove, through which each of the pair of projections is passed, and a plate connecting member connecting the pair of plate members; and in which the lever is attached to a mating connector, and rotated around the projections from a release position, at which a surface of the base plate intersects a lengthwise direction of the guide groove so as to form an angle between surface of the base plate and the guide groove lower than 90 degree, to a slide start position, at which the surface of the base plate is in parallel to the lengthwise direction of the guide groove, and slid along the lengthwise direction of the guide groove; in which the plate connecting member includes a first surface at a side apart from the guide groove and a second surface at a side near to the guide groove, and the first surface is arranged vertically to a slide direction when the lever is located at the slide start position, and the second surface is arranged vertically to a connecting direction when the lever is located at the release position. By providing the first surface, a force by an operator when the lever is slid from the slide start position can be received without division. By providing the second surface, a force by the operator when the lever is pulled along an opposite direction opposite to a connecting direction can be received without division. Thus, the force by the operator can be reduced so that the lever lock connector having good operatability can be provided.

According to the present invention claimed in claim 2, the end at the side near to the plate connecting member of the plate member is curved along the rotating direction. Thereby, the lever can be miniaturized in the lengthwise direction of the guide groove. The plate connecting member is located near to the guide groove which each of the pair of projections as a center of rotating lever is passed through. Thereby, stability of operating the lever can be improved.

According to the present invention claimed in claim 3, a connector unit includes the lever lock connector claimed in claim 1 or 2 and the mating connector which the lever lock connector is connected with. By providing the first surface, a force by an operator when the lever is slid from the slide start position can be received without division. By providing the second surface, a force by the operator when the lever is pulled along an opposite direction opposite to a connecting direction can be received without division. Thus, the force by the operator can be reduced so that the connector unit having good operatability can be provided.

DESCRIPTION OF EMBODIMENTS

Figure 1A:
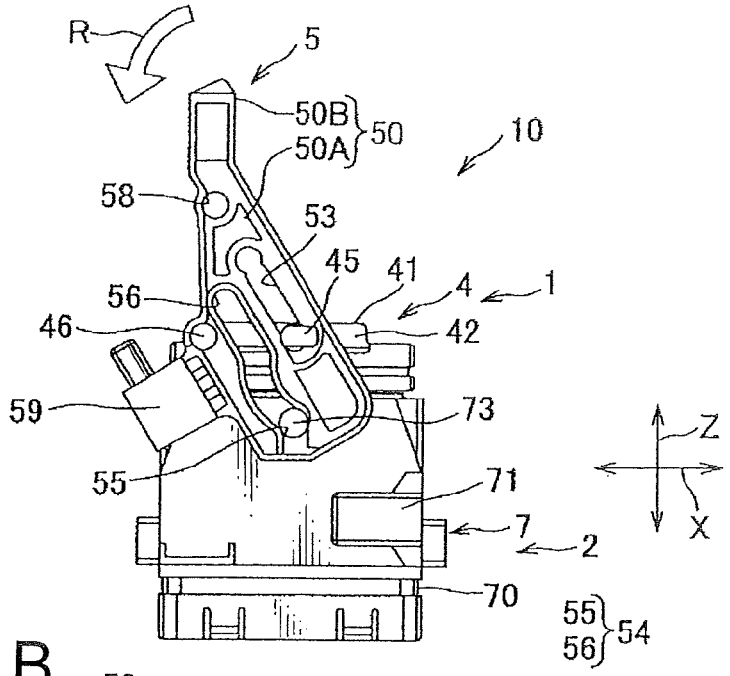
FIG. 1A is a side view of a lever lock connector, which a lever is located at a release position, of a first embodiment according to the present invention.

An electric power circuit breaking apparatus as a connector unit of an embodiment according to the present invention is described with reference to FIGS. 1-3. The electric power circuit breaking apparatus 10 is built in a power supply circuit for supplying electric power from a battery to a load unit, and makes and breaks the power supply circuit when required.

The electric power circuit breaking apparatus 10 as shown in FIG. 1 is provided with a connector 1 as a lever lock connector including a housing 4 having a base plate 41 which a female terminal (not shown) as a terminal is arranged, an side wall 42 extending vertically from an edge of the base plate 41, and a pair of pivots 45 as a pair of projection projecting from the side wall 42 so as to be apart from each other; and a lever 5 formed into U-shape so as to arrange the housing 4 therebetween and having guide grooves 53, each of which each of the pair of pivots 45 is passed through; and a mating connector 2 which is locked with the connector 1 so as to move the housing 4 close to the mating connector 2 by connecting the lever 5 and rotating the lever 5.

Figure 1B:
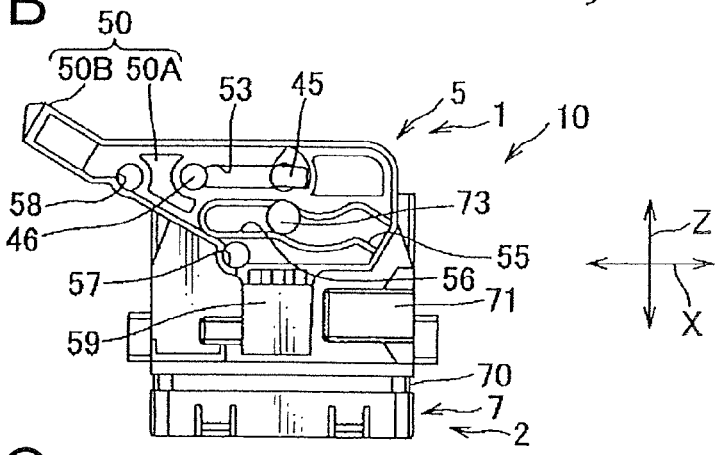
FIG. 1B is a side view of a lever lock connector, which a lever is located at a slide start position, of a first embodiment according to the present invention.
Figure 1C:
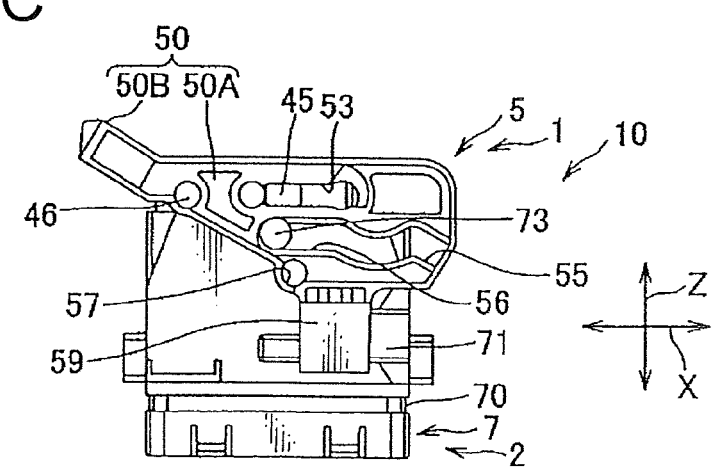
FIG. 1C is a side view of a lever lock connector, which a lever is located at a lock position, of a first embodiment according to the present invention.

In the description, a position in which the lever 5 is attached to the mating connector 2, and a surface of the base plate 41 intersects a lengthwise direction of the guide groove 53, and an angle between the surface of the base plate 41 and the guide groove 53 is made less than 90 degree is defined as a release position (corresponding to FIG. 1A). A position in which the lever 5 is rotated around the pivot 45 from the release position, and thereby the surface of the base plate 41 is arranged in parallel to the lengthwise direction of the guide groove 53 of the lever 5 is defined as a slide start position (corresponding to FIG. 1B). A position in which, after the lever 5 is located at the slide start position, the lever 5 is slid and positioned about the housing 4 along the lengthwise direction of the guide groove 53 is defined as a lock position (corresponding to FIG. 1C).

In the release position, the female terminal is not connected with a later-described male terminal (not shown) arranged at the mating connector 2. The lever 5 is rotated around the pivot 45 from the release position, thereby the housing 4 is connected to a later-described second housing 7 arranged at the mating connector 2, so that the female terminal and the male terminal are connected and the lever 5 is positioned at the slide start position. When the lever 5 is positioned at the slide start position, the power supply circuit is opened (broken). The lever 5 is slid from the slide start position, and the lever 5 is positioned at the lock position, so that the power supply circuit is closed.

An arrow Z shown in FIG. 1 indicates a connecting direction of connecting and pulling (nearing and parting) the connector 1 about the mating connector 2. An arrow X indicates a slide direction of sliding the lever 5 about the housing 4. An arrow R indicates a rotating direction of rotating the lever 5 around the rotation pivot 45.

The side wall 42 is provided with a retractable lock member 46 so as to be aligned with each pivot 45 along the slide direction (direction by the arrow X).

The lever 5 includes a lever main body 50 formed into U-shape by a pair of plate members 50A arranged so as to provide the housing 4 therebetween and an operation member 50B as a plate connecting member connecting the pair of plate members 50A; an outer tube member 59 arranged outwardly from one plate member 50A of the pair of plate members 50A, and a first conductive detect terminal (not shown). The lever main body 50 and the outer tube member 59 are made of insulation resin and formed integratedly by injection mold.

Figure 2:
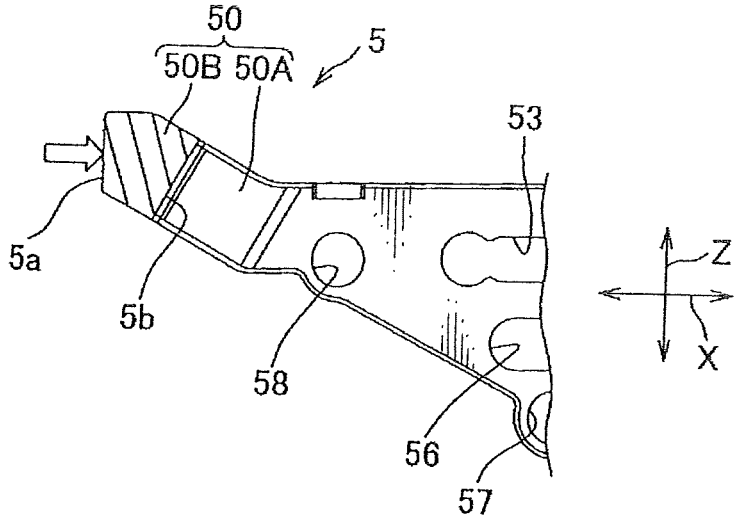
FIG. 2 is a cross-sectional view of the lever shown in FIG. 1C.
Figure 3:
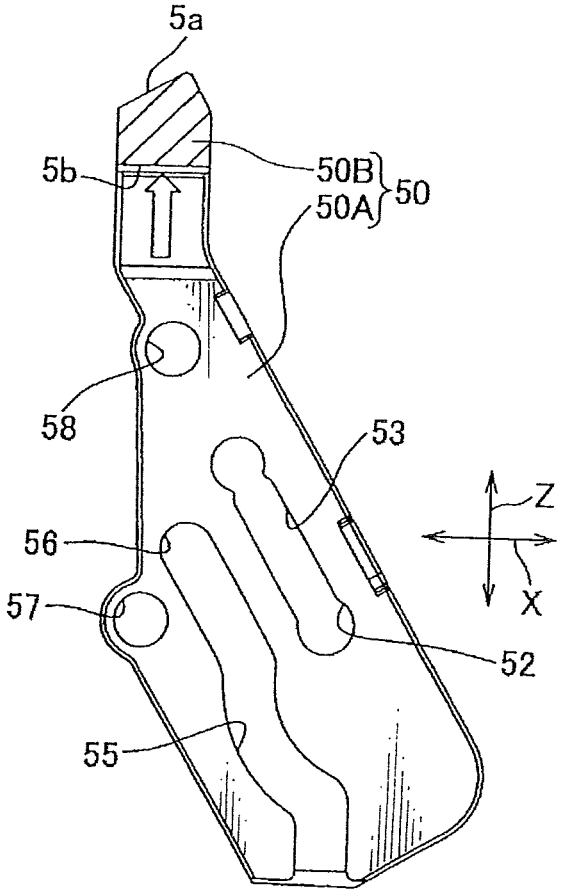
FIG. 3 is a cross-sectional view of the lever shown in FIG. 1A.
Figure 4A:
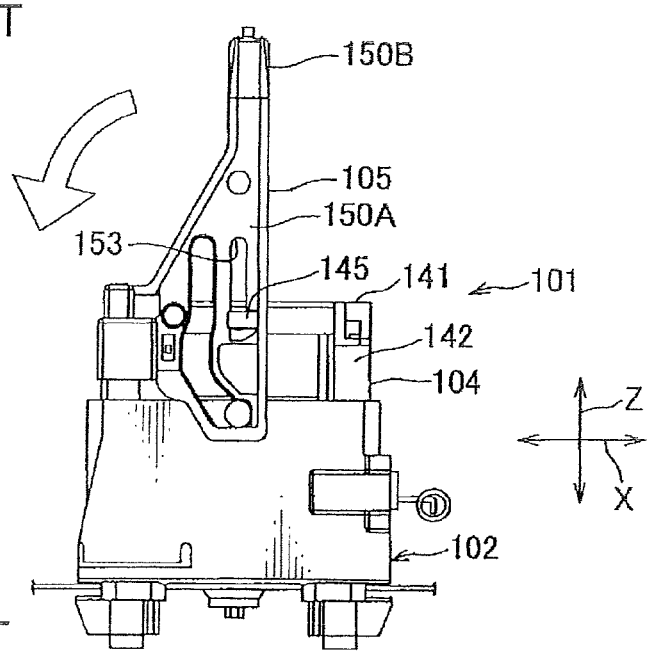
FIG. 4A PRIOR ART
FIG. 4A is a side view of a usual lever lock connector, which a lever is located at a release position, of a first embodiment according to the present invention.
Figure 4B:
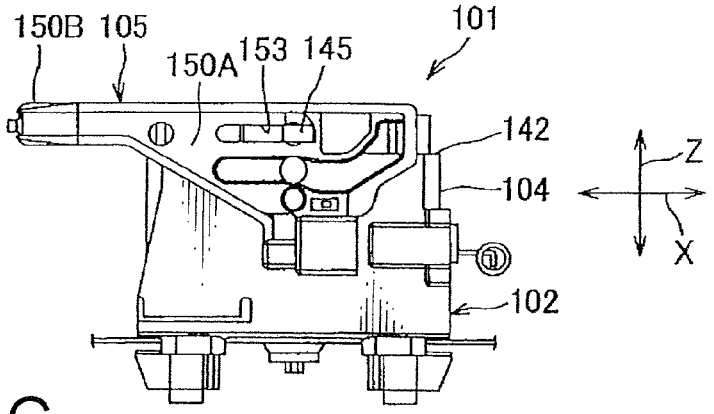
FIG. 4B PRIOR ART
FIG. 4B is a side view of a lever lock connector, which a lever is located at a slide start position, of a first embodiment according to the present invention.
Figure 4C:
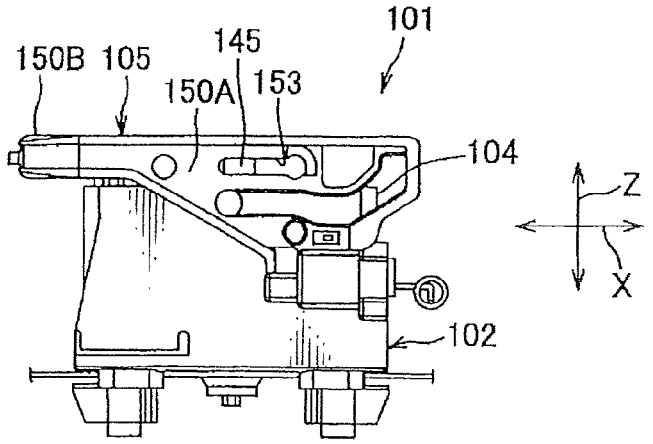
FIG. 4C PRIOR ART
FIG. 4C is a side view of a lever lock connector, which a lever is located at a lock position, of a first embodiment according to the present invention.
Figure 5:
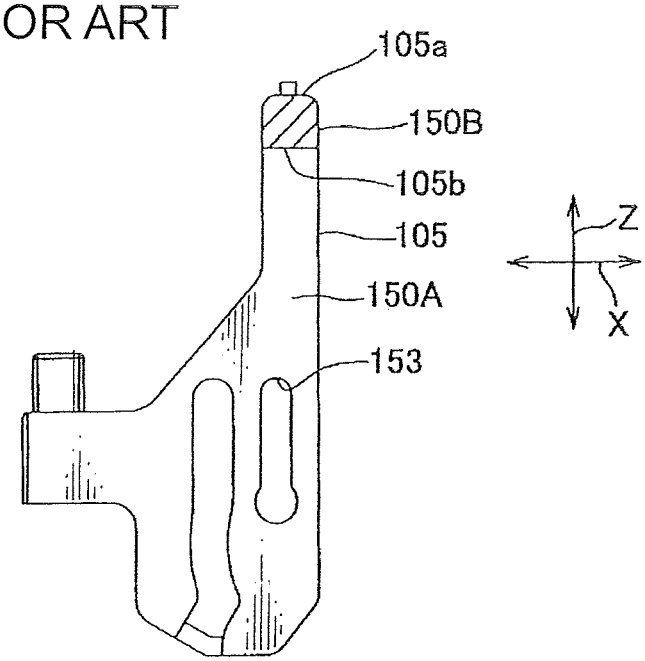
FIG. 5 PRIOR ART
FIG. 5 is a cross-sectional view of the lever shown in FIG. 4A.
Figure 6:
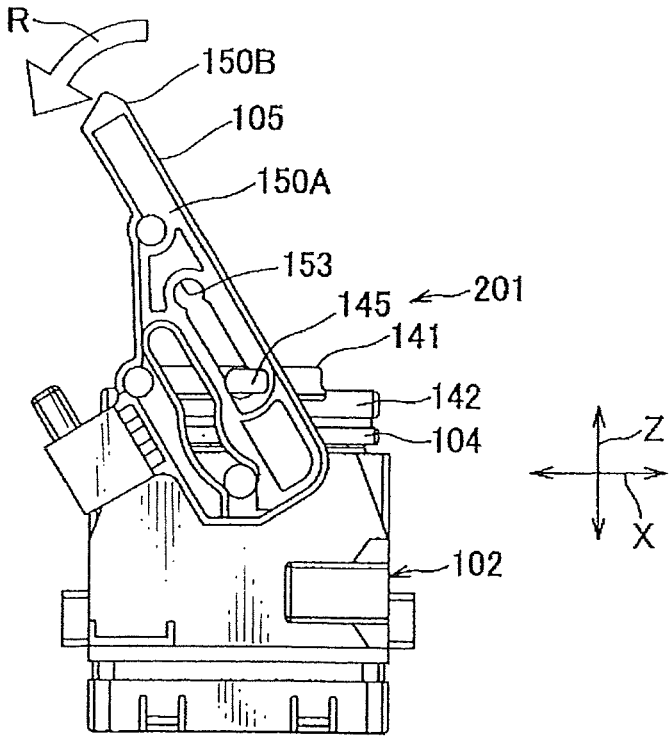
FIG. 6 PRIOR ART
FIG. 6 is a side view of usual another lever lock connector.
Figure 7:
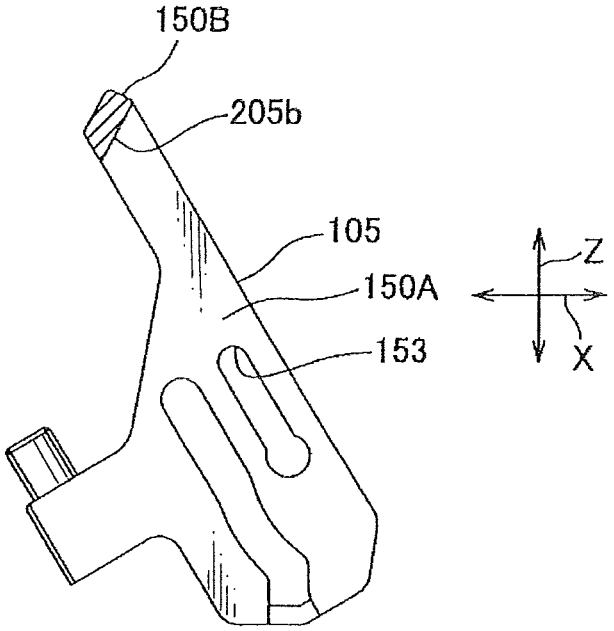
FIG. 7 PRIOR ART
FIG. 7 is a cross-sectional view of the lever shown in FIG. 6.

The above-mentioned pair of plate members 50A, as shown in FIGS. 2, 3, is provided at one end portion thereof with a guide groove 53 formed linearly so as to pass the pivot 45 arranged at the above-mentioned housing 4 therethrough; a cam guide 54 through which a later-described cam pin 73 provided at the mating connector 2; a first lock receiving portion 57 through which the lock member 46 arranged at the housing 4 is inserted when the lever 5 is located at the release position; and a second lock receiving portion 58 through which the lock member 46 arranged at the housing 4 when the lever 5 is located at the lock position. An end portion, at a side of the operation member 50B, of the plate member 50A is curved along the rotating direction R.

The cam groove 54 includes an arc portion 55 formed along a circle around the one end portion so as to penetrate through the plate members 50A, and a second guide groove 56 formed linearly along the guide groove 53. The arc portion 55 is configured to have an opening at an end (outer edge) apart from a plate connecting member 50B of the plate member 50A. A later-described cam pin 73 of the mating connector 2 is inserted into the opening of the cam groove 54 (arc portion 55) which opens at the outer edge) when the lever 5 is located at the release position.

The operation member 50B, as shown in FIGS. 2 and 3, includes a vertical surface 5*a* provided at a side apart from the guide groove 53 so as to be vertical to the slide direction (direction by arrow X) when the lever 5 is located at the slide start position; and a horizontal surface 5*b* provided at a side near to the guide groove 53 so as to be vertical to a direction of parting from the mating connector 2 (direction by arrow Z) when the lever 5 is located at the release position. The vertical surface 5*a* is configured to receive a force by an operator sliding the lever 5 from the slide start position. The horizontal surface 5*b* is configured to receive a force by the operator pulling up the connector 1 in a direction apart from the mating connector 2 (direction by arrow Z).

The outer tube member 59 is formed into tube shape, and a conductive first detect terminal is arranged inside thereof. When the lever 5 is located at the lock position, a later-described inner tube member 71 provided at the mating connector 2 is inserted into the outer tube member 59.

As shown in FIG. 1, the mating connector 2 includes a pair of male terminals arranged in an interval to each other so as to be connected with female terminal; a second housing 7 fitted to the housing 4; and a pair of second detect terminal (not shown) connected to the first detect terminal arranged at the lever 5.

The second housing 7 includes a second main body 70 formed into box shape so as to receive the pair of male terminals, cam pins projecting from the second main body 70 to be apart from each other, and the inner tube member 71 to be inserted into the outer tube member 59 arranged at the lever 5.

The inner tube member 71 is formed into tube shape to have an opening along the slide direction (direction by arrow X) and the pair of second detect terminals is arranged inside thereof.

The pair of second detect terminals is arranged in an interval to each other (to be separated to each other). One of the pair of second detect terminals is connected to a battery, and the other of the pair of second detect terminals is connected to a load. When the lever 5 is located at the lock position, the first detect terminal connects the pair of second detect terminals to each other. Thus, the first detect terminal is electrically connected to the second detect terminal so that the electric power circuit is closed (close circuit is formed).

Procedure for assembling the above-mentioned electric power circuit breaking apparatus 10 is described hereafter with reference to FIG. 1. First, one male terminal of the pair of male terminals is connected through an electric wire to the battery. And the other male terminal is connected to the load, and the mating connector 2 is mounted at the car body, (car body panel).

After the female terminal is mounted in the housing 4, the pair of plate members 50A of the lever 5 is separated to each other so as to arrange the housing 4 between the pair of plate members 50A and insert each pivot 45 into the one end portion of the guide groove 53 of the lever 5. Thereby, the lock member 46 arranged at the housing 4 is inserted into the first lock receiving portion 57. Thus, the connector 1 is assembled.

Successively, the pivot 45 is passed through the one end portion of the guide groove 53 of the lever 5, and the connector 1, in which the lock member 46 is inserted into the first lock receiving portion 57, is moved along the direction by arrow Z near to the mating connector 2, and the cam pin 73 is inserted into the opening of the cam groove 54. Thus, the lever 5 is attached into the mating connector 2 (the second main body 70). Thus, the lever 5 is located at the release position (corresponding to FIG. 1A). In the release position, the surface of the base plate 41 intersects the lengthwise direction of the guide groove 53, and the angle between the surface of the base plate 41 and the guide groove is less than 90 degree, and the horizontal surface 5*b* is arranged to be vertical to the direction of parting (direction by arrow Z).

When the connector 1 is positioned at the release position, the lever 5 is rotated about the housing 4. Thereby, the cam pin 73 is moved inside the arc portion 55 of the cam groove 54 along an inner edge of the arc portion 55. Then, the lock member 46 arranged at the housing 4 is inserted into the other end portion of the guide groove 53 arranged at the lever 5, and the housing 4 is moved near to the mating connector 2 (the second main body 70) and connected to the mating connector 2. Thereby, the pair of male terminals is inserted into female terminal. Thus, the pair of male terminals is connected to each other by the female terminal, and the connectors 1 and 2 are connected. Then, the lever 5 is located at the slide start position (corresponding to FIG. 1B). At the time, the surface of the base plate 41 is arranged in parallel to the lengthwise direction of the guide groove 53, and the vertical surface 5*a* is arranged vertical to the slide direction (direction by arrow X)

After the lever 5 is located at the slide start position, the lever 5 is lid about the housings 4 and 7. At the time, the force by the operator is loaded on the vertical surface 5*a*. Thereby, the cam pin 73 is moved (slid) along the inner edge of the second guide groove 56 inside the guide groove 53, and the pivot 45 is moved (slid) along the inner edge of the guide groove 53 inside the guide groove 53. Then, the lock member 46 is inserted into the second lock receiving portion 58, and the inner tube member 71 arranged at the second housing 7 is inserted into the outer tube member 59 arranged at the lever 5, and the first detect terminal connects the pair of second detect terminals to each other. At the time, the lever 5 is located at the lock position (corresponding to FIG. 1C). Thus, when the lever 5 is located at the lock position, the pair of second detect terminals is electrically connected to each other and the electric power circuit is closed. Therefore, electric current flows from the male terminal to the female terminal. Thus, the electric power circuit breaking apparatus 10 is assembled.

Next, procedure for disconnecting the connector 1 from the connector 2 is described. When the lever 5 is located at the lock position (corresponding to FIG. 1C), the lever 5 is slid along the slide direction (direction by arrow X) about the housings 4 and 7. Thereby, the pivot 45 is moved (slid) along the guide groove 53 arranged at the lever 5, and the cam pin 73 is moved (slid) along the second guide groove 56. Thereby, the inner tube member 71 is pulled out from the outer tube member 59 in which the inner tube member 71 is inserted, and the outer tube member 59 arranged at the lever 5 and the inner tube member 71 arranged at the second housing 7 are parted from each other, so that the first detect terminal and the pair of second detect terminals are parted from each other. Thus, the lever 5 is located at the slide start position.

After the lever 5 is located at the slide start position, the lever 5 is rotated so as to be positioned at the release position. Thereby, the cam pin 73 is moved along an inner edge of the arc portion 55 inside the arc portion 55 of the cam groove 54, and the housing 4 is pulled out from the second main body 70, so that the female terminal and the pair of male terminals are separated from each other. After the lever 5 is located at the release position, the connector 1 is pulled out from the mating connector 2 in the direction of parting (direction by arrow Z). At the time, the force by the operator is loaded on the horizontal surface 5*b*. Thus, the connector 1 is dismounted from the mating connector 2.

According to the above-mentioned embodiment, the connector 1 includes the housing 4 having the base plate 41 which the female terminal as a terminal is arranged, the side wall 42 extending vertically from the edge of the base plate 41, and the pair of pivots 45 as the pair of projections projecting from the side wall 42 so as to be apart from each other; and the lever 5 having the pair of plate members 50A arranging the housing 4 therebetween and having the linear guide groove 53, through which each of the pair of pivots 45 is passed, and the operation member 50B as the plate connecting member connecting the pair of plate members 50A; and the lever 5 is attached to the mating connector and rotated around the pivot 45 from the release position, at which the surface of the base plate 41 intersects the lengthwise direction of the guide groove 53 so as to form an angle between the surface of the base plate 41 and the guide groove 53 lower than 90 degree, to the slide start position, at which the surface of the base plate 41 is in parallel to the lengthwise direction of the guide groove 53, and slid along the lengthwise direction of the guide groove 53; and the operation member 50B includes the vertical surface 5*a* as the first surface at the side apart from the guide groove 53 and the horizontal surface 5*b* as the second surface at the side near to the guide groove 53, and the vertical surface is arranged vertically to the slide direction (direction by arrow X) when the lever 5 is located at the slide start position, and the horizontal surface 5*b* is arranged vertically to a direction opposite to the connecting direction (direction by arrow Z) when the lever 5 is located at the release position. By providing the vertical surface 5*a*, the force by an operator when the lever 5 is slid from the slide start position can be received without division. By providing the horizontal surface 5*b*, the force by the operator when the lever is pulled along the opposite direction opposite to the connecting direction can be received without division. Thus, the force by the operator can be reduced so that the connector 1 having good operatability can be provided.

The end at the side near to the operation member 50B of the plate member 50A is curved along the rotating direction R. Thereby, the lever can be miniaturized in the lengthwise direction of the guide groove 53. The operation member 50B is located near to the guide groove 53 which each of the pair of pivots 45 as the center of rotating lever 5 is passed through. Thereby, stability of operating the lever 5 can be improved.

The connector 1 as the lever lock connector according to claim 1 or 2 includes the mating connector 2 which the connector 1 connects with. By providing the vertical surface 5*a*, the force by the operator when the lever 5 is slid from the slide start position can be received without division. By providing the horizontal surface 5*b*, the force by the operator when the lever 5 is pulled along the opposite direction opposite to the connecting direction can be received without division. Thus, the force by the operator can be reduced so that the connector unit 10 having good operatability can be provided.

The present inventions are described based in the embodiments as mentioned above, but the present invention is not limited in above embodiments. Various change and modifications can be made with the scope of the present invention.

Marks

10 Electric power circuit breaking apparatus (connector unit)
1 Connector (lever lock connector)
2 Mating connector
4 Housing
41 Base plate
42 Side wall
45 Pair of pivots (projections)
5 Lever
50A Pair of plate member
50B Operation member (plate connecting member)
53 Guide groove
5*a* Vertical surface (first surface)
5*b* Horizontal surface (second surface)
Arrow Z Connecting direction
Arrow X Slide direction
Arrow R Rotating direction

The invention claimed is:

1. A lever lock connector, comprising:

a housing including a base plate, in which a terminal is arranged, a side wall extending from an edge of the base plate, and a pair of projections projecting from the side wall so as to be apart from each other; and a lever including a pair of plate members arranging the housing therebetween and having a linear guide groove, through which each of the pair of projections is passed, and a plate connecting member connecting the pair of plate members, wherein the lever is attached to a mating connector, and rotated around the projections from a release position, at which a surface of the base plate intersects a lengthwise direction of the guide groove so as to form an angle between surface of the base plate and the guide groove less than 90 degrees, to a slide start position, at which the surface of the base plate is in parallel to the lengthwise direction of the guide groove, and slid along the lengthwise direction of the guide groove, wherein the plate connecting member includes a first surface at a side apart from the guide groove and a second surface at a side near to the guide groove, the first surface is arranged perpendicular to a slide direction when the lever is located at the slide start position, and the second surface is arranged perpendicular to a connecting direction when the lever is located at the release position.

2. The lever lock connector claimed in claim 1, wherein an end at a side near to the plate connecting member of the plate member is curved along a rotating direction.

3. A connector unit comprising a lever lock connector claimed in claim 1 and a mating connector which the lever lock connector is connected with.

4. A connector unit comprising a lever lock connector claimed in claim 2 and a mating connector which the lever lock connector is connected with.

* * * * *